US005755442A

United States Patent [19]

Cudd

[11] Patent Number: 5,755,442

[45] Date of Patent: May 26, 1998

[54] MARKETING BOARD GAME

[76] Inventor: Marcus Cudd, 410 Orchard View Rd., Reading, Pa. 19606

[21] Appl. No.: 821,215

[22] Filed: Mar. 20, 1997

[51] Int. Cl.[6] ..... A63F 3/04

[52] U.S. Cl. ..... 273/256

[58] Field of Search ..... 273/256, 251–254

[56] References Cited

U.S. PATENT DOCUMENTS

| | | | |
|---|---|---|---|
| 3,318,601 | 5/1967 | MacLeod | 273/257 |
| 3,368,816 | 2/1968 | Milazzo et al. | 273/257 |
| 4,643,429 | 2/1987 | Crandon et al. | 273/251 |
| 5,013,048 | 5/1991 | Turner | 273/254 |

FOREIGN PATENT DOCUMENTS

| | | | |
|---|---|---|---|
| 2189159 | 10/1987 | United Kingdom | 273/254 |

*Primary Examiner*—Benjamin H. Layno

[57] ABSTRACT

A new Marketing Board Game for simulating the expansion of a business from state to state with the objective of gaining the largest market share. The inventive device includes a game board having an illustration of the United States thereon, wherein the illustration of the United States is divided into a plurality of individual states, and a plurality of playing pieces to be moved among the plurality of individual states of the United States. A plurality of query cards having printed thereon a question and an answer corresponding to the question for each of a number of subject matter categories are provided for determining acquisition and ownership of the market share and associated profits of each of the plurality of individual states. A plurality of bonus cards having printed thereon favorable and unfavorable announcements and mandates are provided for introducing instructions to be followed during the course of the game. When a player correctly answers a specified number of questions while in an individual state, the player wins the individual state. As such, the player acquires and gains ownership of the market share and associated profits of the individual state and thus receives the profit figure of the individual state.

13 Claims, 4 Drawing Sheets

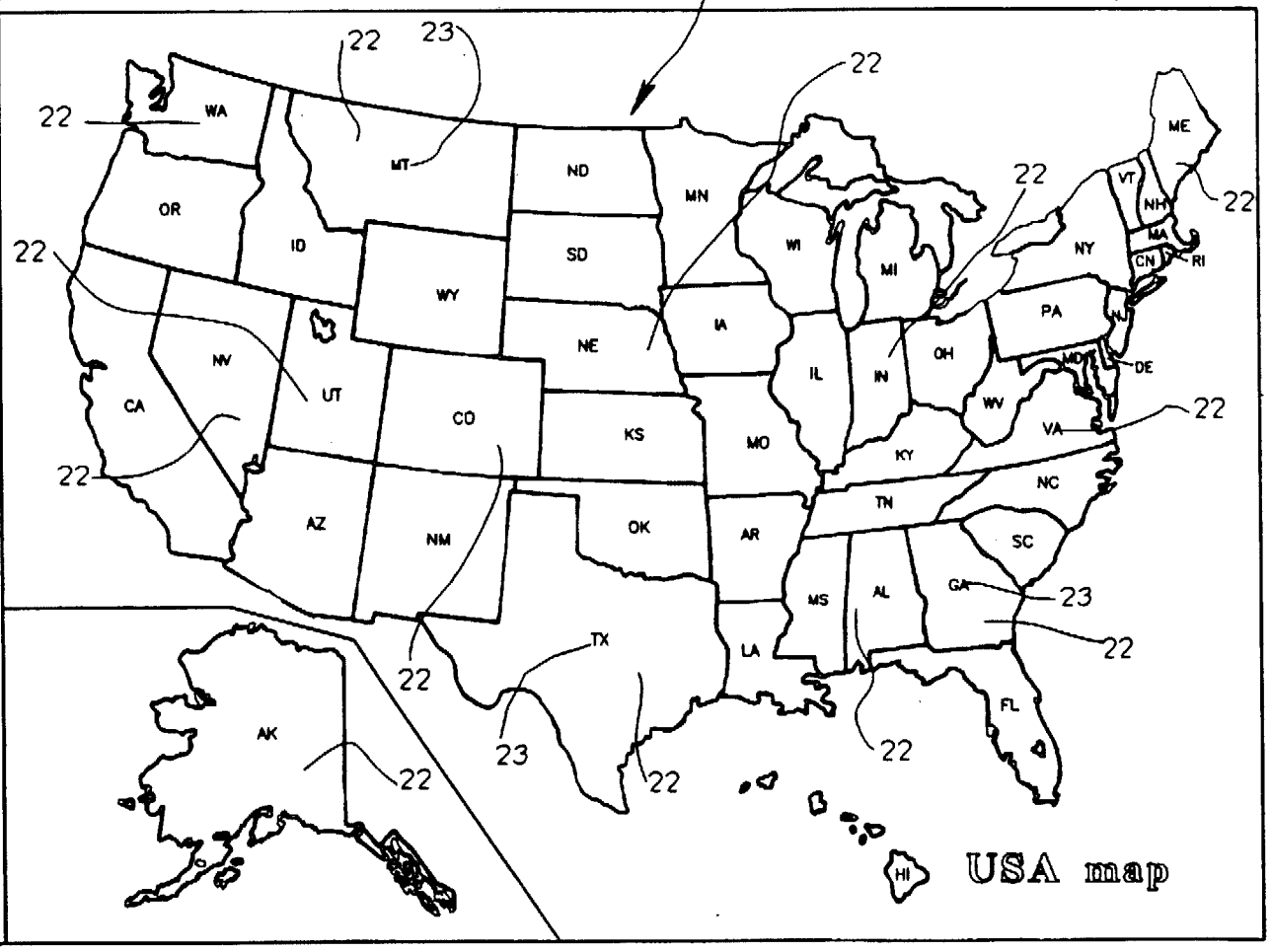

FIG. 1

| STATE | ANSWERS | PROFITS ($) |
|---|---|---|
| ALABAMA | 4 | 35,000,000 |
| ALASKA | 3 | 23,000,000 |
| ARIZONA | 2 | 18,000,000 |
| ARKANSAS | 3 | 29,000,000 |
| CALIFORNIA | 5 | 45,000,000 |
| COLORADO | 3 | 25,000,000 |
| CONNECTICUT | 2 | 18,000,000 |
| DELAWARE | 2 | 14,000,000 |
| FLORIDA | 3 | 37,000,000 |
| GEORGIA | 3 | 29,000,000 |
| HAWAII | 1 | 10,000,000 |
| IDAHO | 3 | 22,000,000 |
| ILLINOIS | 4 | 40,000,000 |
| INDIANA | 3 | 30,000,000 |
| IOWA | 3 | 28,000,000 |
| KANSAS | 4 | 37,000,000 |
| KENTUCKY | 3 | 27,000,000 |
| LOUISIANA | 4 | 32,000,000 |
| MAINE | 2 | 19,000,000 |
| MARYLAND | 2 | 19,000,000 |
| MASSACHUS. | 3 | 23,000,000 |
| MICHIGAN | 4 | 38,000,000 |
| MINNESOTA | 4 | 35,000,000 |
| MISSISSIPPI | 3 | 29,000,000 |
| MISSOURI | 4 | 35,000,000 |
| MONTANA | 3 | 28,000,000 |
| N. CAROLINA | 3 | 28,000,000 |
| N. DAKOTA | 3 | 25,000,000 |
| N. HAMPSHIRE | 2 | 18,000,000 |
| NEBRASKA | 3 | 27,000,000 |
| NEVADA | 2 | 18,000,000 |
| NEW JERSEY | 2 | 20,000,000 |
| NEW MEXICO | 3 | 23,000,000 |
| NEW YORK | 4 | 35,000,000 |
| OHIO | 4 | 35,000,000 |
| OKLAHOMA | 4 | 32,000,000 |
| OREGON | 4 | 31,000,000 |
| PENNSYLVAN. | 4 | 38,000,000 |
| RHODE ISLAND | 2 | 19,000,000 |
| S. CAROLINA | 2 | 20,000,000 |
| S. DAKOTA | 2 | 17,000,000 |
| TENNESSEE | 3 | 27,000,000 |
| TEXAS | 5 | 43,000,000 |
| UTAH | 3 | 48,000,000 |
| VERMONT | 2 | 15,000,000 |
| VIRGINIA | 3 | 28,000,000 |
| W. VIRGINIA | 3 | 30,000,000 |
| WASHINGTON | 4 | 33,000,000 |
| WISCONSIN | 3 | 25,000,000 |
| WYOMING | 2 | 14,000,000 |

24 25 26 27

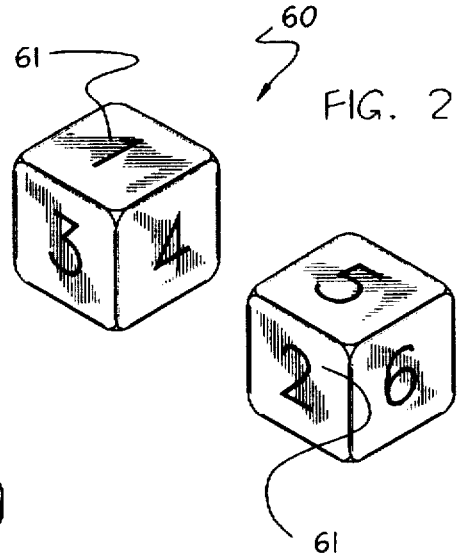
FIG. 2
FIG. 3
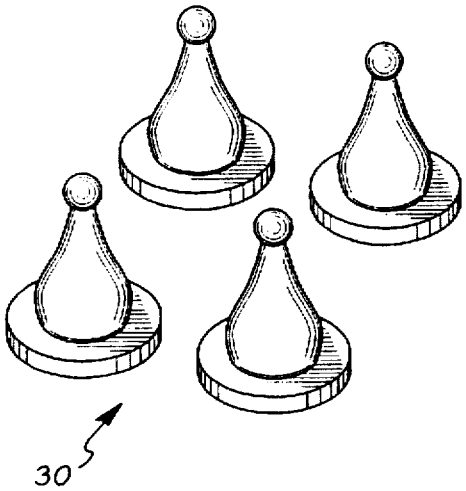
FIG. 4
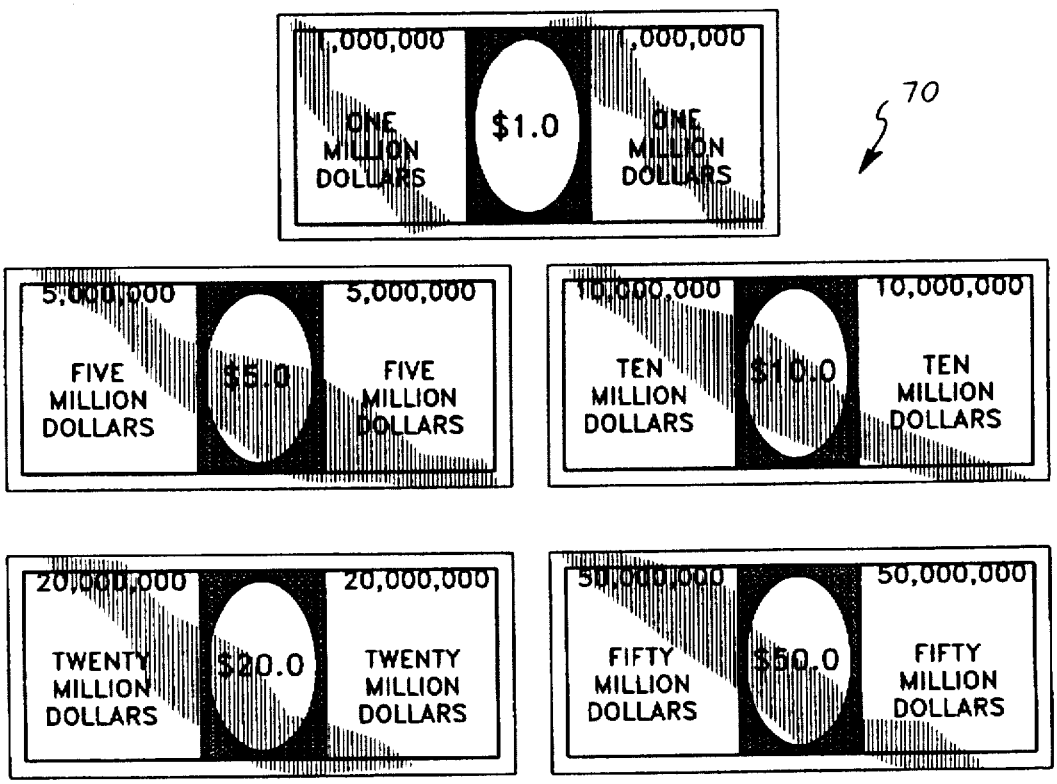

FIG. 5
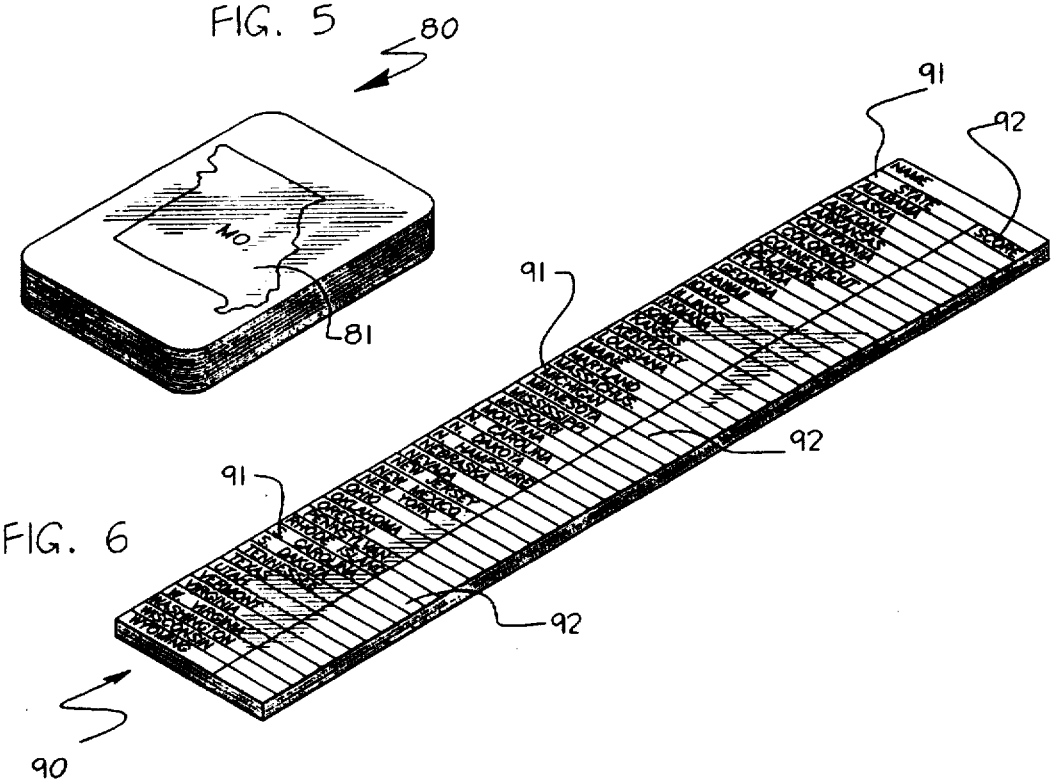
FIG. 6
FIG. 7
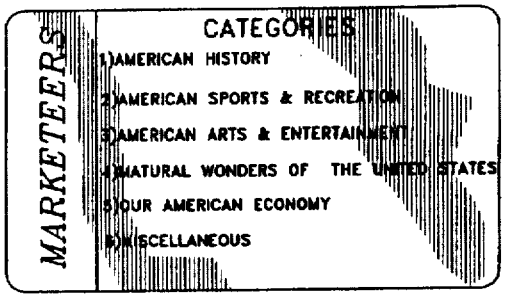

40

50

MARKETING BOARD GAME

BACKGROUND OF THE INVENTION

1. Field of the Invention

The present invention relates to board games and more particularly pertains to a new Marketing Board Game for simulating the expansion of a business from state to state with the objective of gaining the largest market share.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 5,388,836; U.S. Pat. No. 5,407,207; U.S. Pat. No. 4,991,853; U.S. Pat. No. 4,932,668; U.S. Pat. No. D308,703; and U.S. Pat. No. D343,421.

While these devices fulfill their respective, particular objectives and requirements, the aforementioned patents do not disclose a new Marketing Board Game. The inventive device includes a game board having an illustration of the United States thereon, wherein the illustration of the United States is divided into a plurality of individual states, and a plurality of playing pieces to be moved among the plurality of individual states of the United States. A plurality of query cards having printed thereon a question and an answer corresponding to the question for each of a number of subject matter categories are provided for determining acquisition and ownership of the market share and associated profits of each of the plurality of individual states. A plurality of bonus cards having printed thereon favorable and unfavorable announcements and mandates are provided for introducing instructions to be followed during the course of the game.

In these respects, the Marketing Board Game according to the present invention substantially departs from the conventional concepts and designs of the prior art, and in so doing provides an apparatus primarily developed for the purpose of simulating the expansion of a business from state to state with the objective of gaining the largest market share.

SUMMARY OF THE INVENTION

In view of the foregoing disadvantages inherent in the known types of board games now present in the prior art, the present invention provides a new Marketing Board Game construction wherein the same can be utilized for simulating the expansion of a business from state to state with the objective of gaining the largest market share.

The general purpose of the present invention, which will be described subsequently in greater detail, is to provide a new Marketing Board Game apparatus and method which has many of the advantages of the board games mentioned heretofore and many novel features that result in a new Marketing Board Game which is not anticipated, rendered obvious, suggested, or even implied by any of the prior art board games, either alone or in any combination thereof.

To attain this, the present invention generally comprises a game board having an illustration of the United States thereon, wherein the illustration of the United States is divided into a plurality of individual states, and a plurality of playing pieces to be moved among the plurality of individual states of the United States. A plurality of query cards having printed thereon a question and an answer corresponding to the question for each of a number of subject matter categories are provided for determining acquisition and ownership of the market share and associated profits of each of the plurality of individual states. A plurality of bonus cards having printed thereon favorable and unfavorable announcements and mandates are provided for introducing instructions to be followed during the course of the game.

There has thus been outlined, rather broadly, the more important features of the invention in order that the detailed description thereof that follows may be better understood, and in order that the present contribution to the art maybe better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments an d of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Marketing Board Game apparatus and method which has many of the advantages of the board games mentioned heretofore and many novel features that result in a new Marketing Board Game which is not anticipated, rendered obvious, suggested, or even implied by any of the prior art board games, either alone or in any combination thereof.

It is another object of the present invention to provide a new Marketing Board Game which may be easily and efficiently manufactured and marketed.

It is a further object of the present invention to provide a new Marketing Board Game which is of a durable and reliable construction.

An even further object of the present invention is to provide a new Marketing Board Game which is susceptible of a low cost of manufacture with regard to both materials and labor, and which accordingly is then susceptible of low prices of sale to the consuming public, thereby making such Marketing Board Game economically available to the buying public.

Still yet another object of the present invention is to provide a new Marketing Board Game which provides in the apparatuses and methods of the prior art some of the advantages thereof, while simultaneously overcoming some of the disadvantages normally associated therewith.

Still another object of the present invention is to provide a new Marketing Board Game for simulating the expansion of a business from state to state with the objective of gaining the largest market share.

Yet another object of the present invention is to provide a new Marketing Board Game which includes a game board having an illustration of the United States thereon, wherein the illustration of the United States is divided into a plurality of individual states, and a plurality of playing pieces to be moved among the plurality of individual states of the United States. A plurality of query cards having printed thereon a question and an answer corresponding to the question for each of a number of subject matter categories are provided for determining acquisition and ownership of the market share and associated profits of each of the plurality of individual states. A plurality of bonus cards having printed thereon favorable and unfavorable announcements and mandates are provided for introducing instructions to be followed during the course of the game.

Still yet another object of the present invention is to provide a new Marketing Board Game that challenges a player to expand the business of a manufacturing company to multiple states and regions.

Even still another object of the present invention is to provide a new Marketing Board Game that tests a player's strategy for business expansion in an effort to gain profits, while also testing a player's knowledge about the United States and the people who have shaped it and created the various cultures of today.

Even still another object of the present invention is to provide a new Marketing Board Game that challenges a player to gain the greatest market share by answering the required number of questions needed to win each state's approval to expand and build a factory in the state, thus allowing the player to receive the profits for the state.

Even still another object of the present invention is to provide a new Marketing Board Game that offers an entertaining and exciting board game with a marketing theme.

Even still another object of the present invention is to provide a new Marketing Board Game that can educate players on the fundamentals of business and economics.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an illustration of the game board of a new Marketing Board Game according to the present invention.

FIG. 2 is an illustration of the dice for use with the present invention.

FIG. 3 is an illustration of the playing pieces of the present invention.

FIG. 4 is an illustration of the game money of the present invention.

FIG. 5 is an illustration of the plurality of state cards of the present invention.

FIG. 6 is an illustration of a scoring card for use with the present invention.

FIG. 7 is a listing of the categories presented on the plurality of query cards.

DESCRIPTION OF THE PREFERRED EMBODIMENT

Figure 8A:
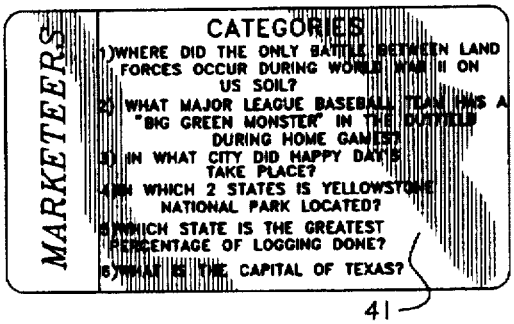
FIG. 8*a* is an exemplary illustration of the first side of a query card of the present invention.

With reference now to the drawings, and in particular to FIGS. 1 through 9 thereof, a new Marketing Board Game embodying the principles and concepts of the present invention and generally designated by the reference numeral 10 will be described.

More specifically, it will be noted that the Marketing Board Game 10 comprises a game board 20 having an illustration of the United States 21 thereon, wherein the illustration of United States 21 is divided into a plurality of individual states 22, and a plurality of playing pieces 30 to be moved among the plurality of individual states 22 provided on the game board 20. A plurality of query cards 40 having printed thereon a question and an answer corresponding to the question for each of a number of subject matter categories are provided for determining acquisition and ownership of the market share and associated profits of each of the plurality of individual states 22. A plurality of bonus cards 50 having printed thereon favorable and unfavorable announcements and mandates are provided for introducing instructions to be followed during the course of the game 10. The Marketing Board Game 10 is marketed under the name "Marketeers" wherein each player runs a new automotive company manufacturing the first full-production electric cars.

As best illustrated in FIG. 1, it can be shown that the game board 20 has an illustration of the United States 21 thereon. The illustration of the United States 21 is divided into a plurality of individual states 22, wherein each of the plurality of individual states 22 represents one each of the fifty (50) states of the United States. Each of the plurality of individual states 22 has indicia 23 printed therein identifying each of the plurality of individual states 22 thereof. Each of the plurality of individual states 22 represents one (1) space for purposes of play of the game 10.

Figure 8B:
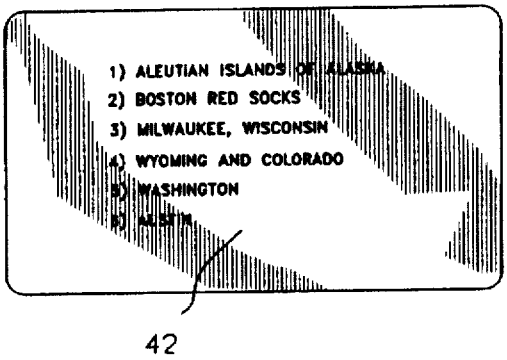
FIG. 8*b* is an exemplary illustration of the second side of a query card of the present invention.

As best illustrated in FIGS. 8*a* and 8*b*, it can be shown that each of the plurality of query cards 40 has provided thereon a question and an answer for each of a number of subject matter categories. The question is provided on a first side 41 of each of the plurality of query cards and the answer is provided on a second side 42 of each of the plurality of query cards. As best illustrated in FIG. 7, it can be shown that the number of subject matter categories includes an "American History" category, an "American Sports and Recreation" category, an "Arts and Entertainment in America" category, a "Natural Wonders of the United States" category, an "Our American Economy" category, and a "Miscellaneous" category.

Figure 9A:
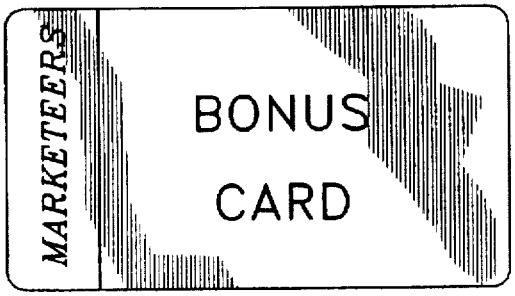
FIG. 9*a* is an illustration of a Bonus Card of the present invention.
Figure 9B:
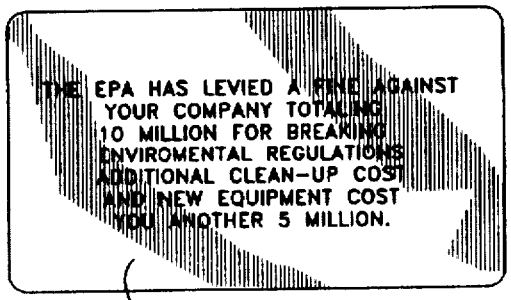
FIG. 9*b* is an exemplary instruction present on the reverse side of a Bonus Card of the present invention.

As best illustrated in FIGS. 9*a* and 9*b*, it can be shown that each of the plurality of bonus cards 50 have favorable and unfavorable announcements and mandates provided on a reverse side 51 thereof. Listed below are examples of the favorable and unfavorable announcements and mandates provided on the plurality of bonus cards 50:

DUE TO EXTREME ECONOMIC DEPRESSION IN WEST VIRGINIA, CONGRESS HAS APPROVED A $10 MILLION FINANCIAL AID PACKAGE FOR THE COMPANY WHICH OPENS A FACTORY IN THAT STATE.

THE EPA, IN AN EFFORT TO BOLSTER CONSUMER INTEREST IN ELECTRIC CARS, HAS AGREED TO HELP FUND AN EXTENSIVE $15 MILLION ADVERTISING CAMPAIGN ON THE CONDITION THATA FACTORY BE OPENED IN GEORGIA.

THE BIG THREE HAVE LOBBIED TO HAVE STRICTER REGULATION AND SAFETY STANDARDS PLACED ON THE COMPANY WITH A FACTORY IN MICHIGAN. THESE IMPROVEMENTS WILL COST THAT COMPANY $35 MILLION.

UNION LEADERS PUBLICLY CHARGE THAT THE FACTORY LOCATED IN TEXAS IS USING ILLEGAL IMMIGRANTS FOR CHEAPER LABOR. THIS SMEAR CAMPAIGN COSTS THAT COMPANY $21 MILLION IN LEGAL FEES.

A PARTS SUPPLIER IS HIT HARD BY A HURRICANE AND IS UNABLE TO SHIP NEEDED MATERIALS TO YOUR FACTORIES. THIS COSTS YOUR COMPANY $25 MILLION IN LOST PRODUCTIVITY.

A TRAIN SHIPPING 500 NEW ELECTRIC CARS FOR YOUR COMPANY DERAILS IN THE NEVADA DESERT, DESTROYING ALL THOSE VEHICLES. YOUR INSURANCE COMPANY REFUSES TO COVER ALL THE DAMAGES AND YOU SUE. AFTER LEGAL EXPENSES AND A LESS-THAN-FAIR SETTLEMENT, THE LOSS TO YOUR COMPANY IS $5 MILLION.

THE GOVERNMENT ANNOUNCES THAT THE QUALITY OF THE CARS COMING OUT OF SOUTH CAROLINA ARE THE INDUSTRY'S BEST. USING THIS IN ADVERTISING, THIS LANDS THAT COMPANY AN ADDITIONAL $20 MILLION IN PROFITS FROM REPEAT BUYERS.

As best illustrated in FIG. 1, it can be shown that a Market Acquisition Chart 24 is provided on the game board 20. The Market Acquisition Chart 24 has market acquisition information thereon and includes a named state 25, a correct answer quota 26 for the named state 25, and a profit FIG. 27 for the named state 25. The named state 25 corresponds to one of the plurality of individual states 22 provided on the game board 20. The correct answer quota 26 indicates a number of questions selected from the plurality of query cards 40 that a player must answer correctly while in the named state 25 in order to acquire the market share associated with the named state 25. The profit FIG. 27 specifies a dollar amount of profits that a player acquires when the player answers questions correctly and satisfies the correct answer quota 26 for the named state 25. In an illustrative embodiment, the correct answer quota 26 and the profit FIG. 27 for the state of Alabama are four (4) and $35 million, respectively. Therefore, to acquire and gain ownership of the market share and associated profits for the state of Alabama a player must answer four (4) questions correctly while in the state of Alabama for which the player receives $35 million in profit. In an illustrative embodiment, the correct answer quota 26 and the profit FIG. 27 for the remaining forty-nine (49) states are provided in the Market Acquisition Chart 24 of FIG. 1.

As best illustrated in FIG. 2, it can be shown that a pair of dice 60 are provided for determining movement among the plurality of individual states 22 and for determining from which category of the number of subject matter categories a question shall be asked of the player. A first of the pair of dice 60 represents the number of spaces (each state represents one space) among which a player may move a playing piece 30 and a second of the pair of dice 60 represents the category from which a question shall be asked and an answer sought. In an illustrative embodiment, each of the pair of dice 60 are six-sided and have indicia 61 thereon representing the numbers one (1) through six (6). In an illustrative embodiment, the first of the pair of dice 60 is white in color and the second of the pair of dice 60 is yellow in color.

As best illustrated in FIG. 3, it can be shown that a plurality of playing pieces 30 are provided for movement among the plurality of individual states 22 provided on the game board 20.

As best illustrated in FIG. 4, it can be shown that game money 70 is provided in denominations of $1.0 million, $5.0 million, $10.0 million, $20.0 million, and $50.0 million. The game money 70 is provided for making payments mandated by the plurality of bonus cards 50 and for distributing profits to a player when the player acquires and gains ownership of the market share and associated profits of one of the plurality of individual states 22.

As best illustrated in FIG. 5, it can be shown that a plurality of state cards 80 each having indicia 81 printed thereon representing one of the plurality of individual states 22 are provided for indicating acquisition and ownership of the market share and associated profits of one of the plurality of individual states 22. A corresponding one of the plurality of state cards 80 is distributed to a player when the player acquires and gains ownership of the market share and associated profits of one of the plurality of individual states 22.

As best illustrated in FIG. 6, it can be shown that a score card 90 is provided for tallying the number of questions a player answers correctly while in one of the plurality of individual states 22. The score card 90 includes a named state 91 and a tally area 92 for the named state 91. The named state 91 corresponds to one of the plurality of individual states 22 provided on the game board 20 and the number of questions a player answers correctly while in one of the plurality of individual states 22 is recorded in the tally area 92.

To play the Marketing Board Game 10, a game board 20 having an illustration of the United States 21 thereon, wherein the illustration of the United States 21 is divided into a plurality of individual states 22, a plurality of playing pieces 30 to be moved among the plurality of individual states 22, a plurality of query cards 40 having printed thereon a question and an answer corresponding to the question for each of a number of subject matter categories, a plurality of bonus cards 50 having printed thereon favorable and unfavorable announcements and mandates, a pair of dice 60, and a quantity of game money 70 are provided. A plurality of state cards 80 each representing one of the plurality of individual states 22 and a score card 90 are also provided.

To begin play, each player receives $15 million of game money 70 and positions one of the plurality of playing pieces 30 in a designated starting state. In an illustrative embodiment, the designated starting state is Delaware. Each player rolls one of the pair of dice 60, and the player receiving the highest roll begins play. The player rolls the pair of dice 60 to determine the number of spaces among which the player may move his or her playing piece 30 and to determine from which of the number of subject matter categories a question shall be selected. The player moves his or her playing piece 30 the number of spaces represented on the first of the pair of dice 60, wherein each of the plurality of individual states 22 provided on the game board 20 represents one space. A player may move his or her playing piece 30 only among adjoining states. In an illustrative embodiment, a player may enter the state of Alaska only from the state of Arizona and may enter the state of Hawaii only from the state of Alaska. Two or more players may occupy the same state at the same time and thus compete for the profit FIG. 27 of the named state 25 as provided in the Market Acquisition Chart 24.

If a player rolls doubles, the player must select one of the plurality of bonus cards 50 and follow the instructions provided on the reverse side 51 thereof. If the selected bonus card has an instruction thereon pertaining to one of the plurality of individual states 22 and the state is occupied, the player occupying the state must adhere to the instruction. However, if the state is unoccupied, then the selected bonus card is placed face-up until a player occupies the state, at which time the player must adhere to the instruction. If the selected bonus card has an instruction thereon pertaining to a player, the player must adhere to the instruction immediately.

After the player moves his or her playing piece 30 the number of spaces represented on the first of the pair of dice 60, one of the plurality of query cards 40 is selected. A question is read from one of the number of subject matter categories corresponding to the result of the second of the pair of dice 60. The player provides an answer to the read question and a determination is made as to whether the provided answer is correct. If a player provides an incorrect answer, the player's turn is over. If, however, the provided answer is correct, the player receives one (1) point for the individual state 22 in which the player is positioned. The point is recorded in the tally area 92 of the score card 90 corresponding to the named state 91. When a player provides a correct answer, the player receives another turn and is allowed to roll the pair of dice 60 again. A player may remain in the same state for consecutive turns, however, if the player chooses to do so the player must pay $5 million to the bank for being allowed to remaining in the same state on consecutive turns.

When a player answers questions correctly and satisfies the correct answer quota 26 for the named state 25 as provided in the Market Acquisition Chart 24, the player "wins" the individual state and receives one of the plurality of state cards 80 corresponding to the individual state. As such, the player acquires and gains ownership of the market share and associated profits of the individual state and thus receives the profit FIG. 27 of the named state 25 as provided in the Market Acquisition Chart 24.

If, by occupying several individual states, a first player surrounds an individual state occupied by a second player, the first player can force the second player to surrender the individual state and the corresponding profit FIG. 27. For example, if a first player occupies the state of Alabama and the state of Georgia and a second player occupies the state of Florida, the second player must surrender the state of Florida and the corresponding profit figure of $32 million to the first player. A player can surround and force surrendering thereof of up to three individual states. However, a coastal state can only be surrounded and forced to be surrendered by itself. In addition, only occupied states can be surrounded and forced to be surrendered.

When one player has earned the most game money or the other players concede that they cannot catch him or her, then that player is declared the winner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A marketing board game comprising:

a game board having an illustration of the United States thereon, said illustration of the United States divided into a plurality of individual states;

a plurality of playing pieces to be moved among said plurality of individual states of said game board;

a plurality of query cards, each of said plurality of query cards having provided thereon a question and an answer corresponding to said question for each of a number of subject matter categories;

said plurality of query cards determine acquisition and ownership of a market share and associated profits thereof for each of said plurality of individual states;

a quantity of game money for use during play of said game;

a die for determining movement of said plurality of playing pieces among said plurality of individual states and for determining from which of said number of subject matter categories said question shall be selected;

a market acquisition chart having market acquisition information for each of said plurality of individual states provided thereon, said market acquisition information including a named state, said named state corresponding to one of said plurality of individual states provided on said game board, a correct answer quota for said named state, said correct answer quota indicating a requisite number of said questions from said plurality of query cards that a player must answer correctly while in said named state in order to acquire said market share and associated profits thereof for each of said plurality of individual states, and a profit figure for said named state, said profit figure specifying a dollar amount of profits that a player acquires when said player satisfies said correct answer quota for said named state.

2. The marketing board game of claim 1, further comprising:

a plurality of state cards, each of said plurality of state cards representing one of said plurality of individual states provided on said game board, each of said plurality of state cards indicating acquisition and ownership of said market share and associated profits thereof of one of said plurality of individual states.

3. The marketing board game of claim 1, further comprising:

a score card for tallying a successful number of said questions from said plurality of query cards that a player answers correctly while in one of said plurality of individual states.

4. The marketing board game of claim 3, wherein said score card includes:

a score-card named state, said score-card named state corresponding to one of said plurality of individual states provided on said game board, and a tally area for said score-card named state, said successful number of said questions that a player answers correctly while in one of said plurality of individual states being recordable in said tally area.

5. The marketing board game of claim 1, wherein each of said plurality of query cards has a first side and a second side, and wherein said question provided on each of said plurality of query cards is provided on said first side and said answer provided on each of said plurality of query cards is provided on said second side.

6. The marketing board game of claim 1, wherein said number of subject matter categories includes at least one of an American history category, an American sports and recreation category, an arts and entertainment in America category, a natural wonders of the United States category an our American economy category, and a miscellaneous category.

7. The marketing board game of claim 1, wherein said game money is provided in denominations of $1.0 million, $5.0 million, $10.0 million, $20.0 million, and $50.0 million.

8. The marketing board game of claim 1, wherein each of said plurality of individual states represents one each of the fifty states of the United States.

9. The marketing board game of claim 1, wherein each of said plurality of individual states represents one space during play of said game.

10. The marketing board game of claim 1, further comprising:

a plurality of bonus cards having at least one of a favorable and an unfavorable announcement and mandate thereon, each of said plurality of bonus cards introducing instructions to be followed during play of said game.

11. A method of playing a Marketing Board Game, comprising the steps of:

(a) providing a game board having an illustration of the United States thereon, wherein said illustration of the United States is divided into a plurality of individual states;

(b) providing a plurality of query cards having provided thereon a question and an answer corresponding to said question for each of a number of subject matter categories;

(c) distributing an initial quantity of game money to each player;

(d) positioning a playing piece in one of said plurality of individual states provided on said game board;

(e) rolling a die to determine movement of said playing piece among said plurality of individual states and to determine from which of said number of subject matter categories said question shall be selected;

(f) moving said playing piece among said plurality of individual states provided on said game board corresponding to a result of said rolled die;

(g) selecting one of said plurality of query cards and reading said question from said selected query card corresponding to a result of said rolled die;

(h) providing an answer to said read question and determining whether said provided answer is correct, wherein if said provided answer is incorrect a player's turn is completed, wherein if said provided answer is correct a player receives credit for a one of said plurality of individual states in which said player is positioned and receives another turn;

(i) awarding ownership of a market share and associated profits thereof of a one of said plurality of individual states to a player and distributing a quantity of game money representing a profit figure for said one of said plurality of individual states to said player when said player satisfies a correct answer quota for said one of said plurality of individual states; and (j) repeating steps (e) through (i) above to complete play of said game.

12. The method of playing the Marketing Board Game of claim 11, further comprising the steps of:

(k) providing a plurality of bonus cards having at least one of a favorable and an unfavorable announcement and mandate thereon; and (l) distributing one of said plurality of bonus cards to a player upon occurrence of a predetermined event.

13. The method of playing the Marketing Board Game of claim 12, further comprising the steps of:

(m) providing a plurality of state cards, each of said plurality of state cards representing one of said plurality of individual states; and (n) distributing one of said plurality of state cards to a player when said player acquires and gains ownership of said market share and associated profits thereof of one of said plurality of individual states.

* * * * *